United States Patent [19]

Chapman

[11] Patent Number: 4,633,754

[45] Date of Patent: Jan. 6, 1987

[54] FRET ROD FOR STRINGED MUSICAL INSTRUMENTS

[76] Inventor: Emmett H. Chapman, 8320 Yucca Trail, Los Angeles, Calif. 90046

[21] Appl. No.: 831,226

[22] Filed: Feb. 19, 1986

[51] Int. Cl.[4] ..... G10D 3/06

[52] U.S. Cl. ..... 84/314 R

[58] Field of Search ..... 84/314 R, 314 N

[56] References Cited

U.S. PATENT DOCUMENTS 3,273,439 9/1966 Keebe et al. ..... 84/314 R
3,712,952 1/1973 Terlinde ..... 84/314 R
3,787,600 1/1974 Muncy ..... 84/314 R
3,791,252 2/1974 Sibert et al. ..... 84/314 R

FOREIGN PATENT DOCUMENTS 1450582 9/1976 United Kingdom ..... 84/314 R

*Primary Examiner*—Lawrence R. Franklin
*Attorney, Agent, or Firm*—Nilsson, Robbins, Dalgarn, Berliner, Carson & Wurst

[57] ABSTRACT

A fretted fingerboard having transverse, shallow U-shaped grooves which receives circular fret rods formed from durable metal provides an improved playing surface for fretted stringed instruments.

7 Claims, 3 Drawing Figures

FRET ROD FOR STRINGED MUSICAL INSTRUMENTS

FIELD OF THE INVENTION

The present invention relates generally to improvements in fretted fingerboards for stringed musical instruments.

BACKGROUND OF THE INVENTION

A fret is a thin strip of material placed across the fingerboard of instruments such as the lute, guitar, balalaika, banjo, and various Indian and Arab instruments which provides the position for stopping the strings. Initially, frets were made from pieces of cat gut that were tied tightly around the neck of the instruments at an appropriate position. For modern instruments frets are narrow strips of metal affixed to a fingerboard. On European instruments the frets are generally arranged so as to give a succession of semitones.

Modern frets generally comprise T-shaped members which have small retaining barbs on the stem of the "T". The frets are hammered or otherwise forceably wedged into slots in the wooden fretboard where they are retained by the barbs. For this reason, frets have traditionally been made from a reasonably malleable metal such as a copper, zinc and nickel alloy referred to as German or nickel silver so that the frets will be sufficiently resilient to be hammered or otherwise wedged into the receiving slots. While such relatively soft metal fret wire has been desirable due to ease of insertion in the receiving slots, the softness of the frets results in rapid fret wear from the vibrating strings of the instrument, and it is not uncommon to find that traditional soft metal frets must be replaced as often as once or twice a year on instruments which are used by professional musicians. Attempts to form traditional T-shaped fret wire from more durable metals such as steel which would provide extended life following installation, have resulted in frets which are extremely difficult to install without extensive damage to the fingerboard.

In recent years, fretted instruments and instrument fingerboards have been constructed from various resinous materials such as hand-laid composites or molded thermoplastic materials, and the use of traditional frets with such instruments has been less than satisfactory due to the fact that a thermoplastic fingerboard is not sufficiently resilient to enable insertion of traditional T-shaped frets. Attempts to mold frets as part of the fingerboard in less expensive, non-professional instruments have been made, but since the frets are easily abraded by the string action when metal strings are employed this method is not satisfactory.

Accordingly, it has been a desideratum to provide a fret or fretboard which would overcome the described disadvantages.

SUMMARY OF THE INVENTION

According to the present invention, a cylindrical fret is provided which is embedded in a groove which is cut or molded in the fingerboard of the fretted instrument. The grooves are U-shaped in cross-section, and the cylindrical axis of the fret, that is, the center of the fret, is below the playing surface of the fingerboard.

The cylindrical fret is retained in the U-shaped groove by dispensing an appropriate flowable adhesive agent along the bottom of the groove. When the cylindrical fret is pressed into the groove the adhesive agent is forced to exude around the cylindrical fret rod toward the playing surface prior to cure, to fill the open spaces at the top of the U-shaped groove, and thus secure the fret rod as if the groove were circular rather than U-shaped. Thus, hard and durable fret rods such as stainless steel may be employed and easily inserted. In addition, the grooves may include thin bridges or webbing members which are disposed across the groove below the playing surface, and which are received in mating slots which are formed in the lower side of the fret rod. This bridge and slot arrangement has been found to provide significant advantages in retaining the rods in the fret grooves.

More particularly, a unitary fingerboard is provided which has an elongate body member with a playing surface having a series of grooves which are disposed transversely with respect to a longitudinal dimension of the body member or fingerboard. The grooves are each essentially U-shaped in cross-section, and include a circularly arcuate portion having the arcuate center below the playing surface, that is, with the distance between the transverse edges of each groove at the playing surface being no less than twice the radius of the arcuate portion. A cylindrical fret member is adhesively secured in each of the grooves, each of the fret members being circular in cross-section and matingly engaging the circularly arcuate groove portion with the cylindrical axis of the fret member lying below the playing surface, with the adhesive extending the circular configuration of the circularly arcuate groove portion around the fret rod to the level of the playing surface. Each of the transverse grooves may include at least one bridge member disposed across the groove and below the playing surface, and each of the fret members has at least one slot formed across the fret member which matingly receives a bridge member in the transverse groove.

Significant advantages are provided by the invention. The resulting fret-fretboard combination is aesthetically pleasing, with the exposed cylindrical shapes of the fret rods visible from the sides. The frets are less susceptible to displacement by physical impact due to the larger, embedded portion of the rods, the exfiltration of the glue to fill the void formed between the U-shaped groove and the circular fret rod, and the interlocking of the bridge-grooves and fret-slots. Moreover, the frets are virtually invulnerable to fret wear, because hard metals such as stainless steel can be used instead of the soft metals necessary for hammered-in frets. Finally, while traditional T-shaped frets cannot completely fill the receiving slot in the fingerboard, the fret rods of the invention mate closely with the U-shaped grooves in the fingerboard, thus providing an essentially void-free fingerboard structure which has increased rigidity and stiffness, thus providing superior tonal qualities.

DESCRIPTION OF THE PREFERRED EMBODIMENT

Figure 1:
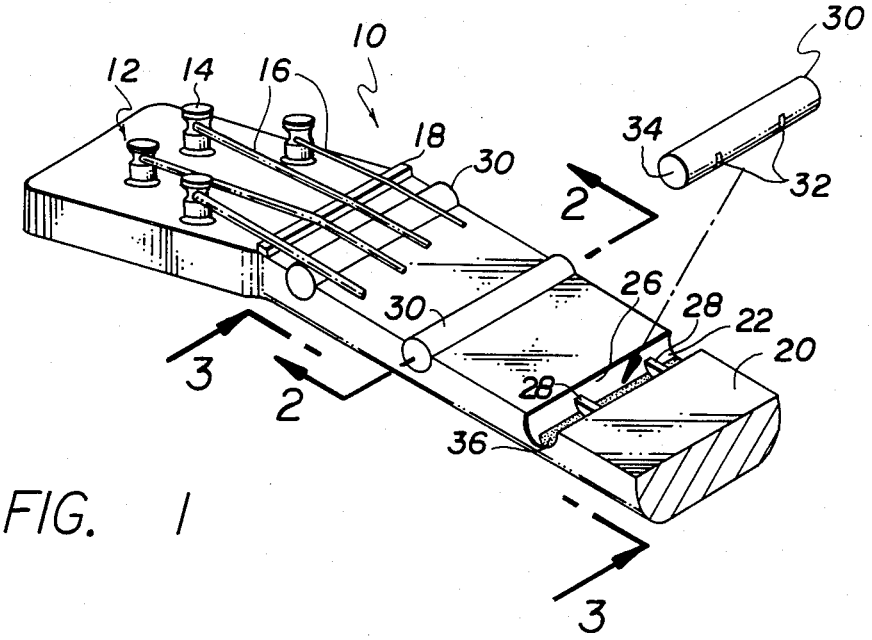
FIG. 1 is a perspective view of a portion of a guitar neck and fretboard in accordance with the invention.
Figure 2:
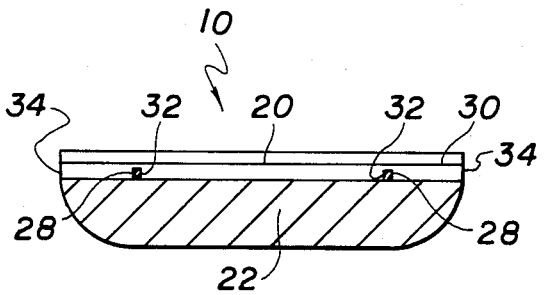
FIG. 2 shows a sectional end view taken along the line 2—2 in FIG. 1.

Referring to FIG. 1, a portion of a guitar neck 10 is shown. In this instance, the guitar neck is shown to be of unitary construction, i.e., molded in one piece from thermoplastic material. However, the invention is equally adaptable to fretboards which are made in the more traditional manner which includes a separate wooden fretboard, i.e., playing surface, which is secured to the guitar neck.

The neck 10 is seen to include a string-retaining portion 12, commonly referred to as a peg head, on which are mounted adjustable tuning pegs 14 in order to tension a plurality of strings 16. The strings course from the peg head 12 over a nut or string guide 18 toward the opposite end of the instrument. The neck 10 also includes a playing surface 20.

Figure 3:
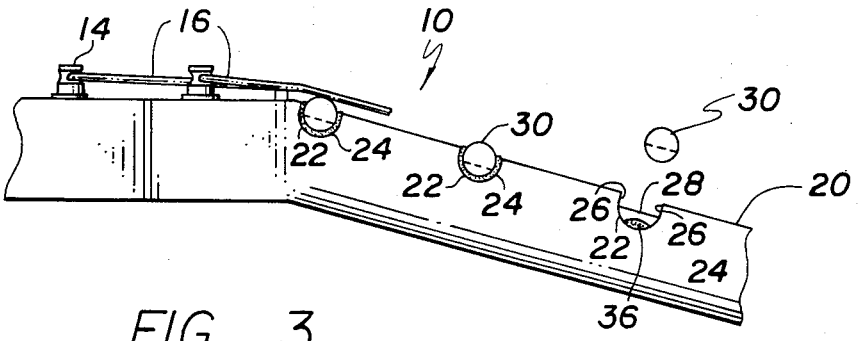
FIG. 3 is a side view taken as on the line 3—3 of FIG. 1.

In FIGS. 1 and 3, the neck 10 is seen to include a plurality of grooves 22, each at the proper location to provide the appropriate musical pitch for the instrument. Each of the grooves 22 is seen to be disposed transversely with respect to the longitudinal dimension of the body member as indicated by the direction of the strings 16, and is essentially U-shaped in cross-section. The playing surface 20 is seen to be of unitary construction, that is, formed from a single piece of material rather than being comprised of a plurality of separate fingerboard sections disposed between the grooves 22. As shown in the cross-sectional view of FIG. 3, the U-shaped section is seen to be formed by a circularly arcuate portion 24 having an arcuate center below the playing surface 20. Above the arcuate portion 24, groove walls 26 extend in a direction which is essentially perpendicular to the playing surface 20.

The grooves 22 may be formed by a variety of methods. For example, the arcuate portion 24 of the grooves 22 may be routed with a U-shaped bit, or by other means, to produce the U-shaped form. However, in the preferred embodiment the grooves are formed during the molding of the neck 10 as later described.

Preferably, the grooves include at least one bridge or webbing member 28 disposed across the groove and below the playing surface 20.

According to the invention, fret members or rods 30 are seen to be received by the grooves 22, and are shown to matingly engage the circularly arcuate groove portion 24. Since the arcuate center of the portion 24 lies below the playing surface 20, the cylindrical axis of the fret member 30 is also seen to lie beneath the playing surface. The fret members 30 are seen to include at least one slot 32 formed across the fret member 30 which matingly receives a bridge member 28 when the fret 30 is placed in the groove 22.

In order to provide clearance for the musician's fingers along the lateral edges of the playing surface 20, the frets 30 are seen to include beveled edges 34.

The fret rods may be made from any type of metal, but a durable metal such as type 203 stainless steel rod is preferred. The fret rods 30 are secured in the grooves 22 through the use of an appropriate adhesive agent. With respect to most thermoplastic guitar necks, an epoxy adhesive is preferred. As shown in FIGS. 1 and 3, a thin pool of epoxy adhesive 36 is evenly dispensed along the groove 22. The fret rod 30 is then pressed into the groove and with slight finger pressure the adhesive, which is preferably of low viscosity, exudes along the groove walls 26 along the circular walls of the fret 30 to a point which is at least even with the playing surface 20. Any excess adhesive agent which extends above the playing surface 20 can be wiped off by the installer, or left slightly above the fingerboard surface. Thus, the cured adhesive agent fills the space in the "U" that is not occupied by the cylindrical fret 30 and, in effect, extends the playing surface 20 to close upon the fret as if the groove were circular instead of U-shaped. Since the groove is thus U-shaped prior to insertion and circular after the adhesive has cured, the normal surface adhesion of the metal to thermoplastic is substantially augmented. In addition, the neck 10 is essentially void-free along the playing surface 20.

The frets 30 are cut from available metal stock of the appropriate diameter, and the slots 32 and bevels 34, as well as the required length of the fret 30, may be predetermined and easily machined during the manufacturing process. In the event that a transversely arcuate playing surface 20 is required, as in some guitars, the grooves 22 may be molded with a configuration which is transversely arcuate to the longitudinal dimension of the guitar neck, and the frets 30 may easily be bent and machined to matingly engage with the arcuate groove 22.

Preferably, the neck 10 or the entire instrument, in the case of a bodiless guitar, is injection-molded from polycarbonate resin in a manner which may be accomplished by one skilled in the art of injection molding without undue effort or experimentation. The smooth U-shaped protrusions which extend into the mold provide for non-turbulent flow of the plastic into the mold as compared to the angular protrusions required to form slots which will receive traditional T-shaped frets. Thus, uneven heat and pressure distribution in the interior of the mold, and the resultant voids and textural variations in the fingerboard surface, are avoided. It is preferred to provide draft angles of 1°–3° for all vertical planes in the mold, and thus the U-shape is a very slightly open "U". Such draft angles allow the neck 10 to be easily removed from the mold.

More specifically, an instrument of polycarbonate material was molded having twenty-five molded grooves transversely disposed across the fingerboard. The grooves were a shallow "U" shape having a depth below the playing surface of 0.093 inches. The radius of the arcuate groove portion was 0.79 inches, thus providing a groove width at the arcuate center of 0.158 inches. Above the arcuate center, the groove walls diverged outwardly at an angle of about 2°.

The width of the neck 10, which is uniform throughout the longitudinal dimension of the playing surface, is 3.25 inches. Two groove bridges having a width of 0.0625 inches were formed by slots provided in the mating groove protrusions of the mold, and located about 0.875 inches from each edge of the neck, or 1.5 inches center to center. The groove ridges were formed with an upper surface which was essentially parallel to the playing surface and about 0.065 inches above the lowest point of the groove.

Fret rods were machined from type 203 stainless steel stock having a diameter of 0.156 inches, 0.002 inches less than the semi-circular diameter of the groove. The frets were machined with a 45° bevel on the upper transverse edges beginning 0.065 inches below the top surface of the fret. The bridge-receiving slots were machined on the lower portion of the fret to a depth of 0.070 inches. The slots were centered on 1.5 inch centers and were about 0.063 inches wide. The overall length of the fret was sized to that of the transverse dimension of the fretboard, i.e., 3.25 inches.

When received in the groove, the center of the fret was thus 0.012 inches below the playing surface of the fretboard. As described above, a thin pool of epoxy adhesive (Devcon (TM) 30-minute epoxy) was placed across the bottom of the groove, and a fret rod pressed into the groove. The excess glue exuded to the top of the U-shaped groove, and the excess adhesive was removed even with the playing surface.

The use of fret rods of varying diameters is, of course, within the purview of the invention. However, the 0.156 inch diameter rods were chosen because they have a top curvature similar to that of a conventional fret, as well as a similar height of 0.065 inches above the playing surface when embedded in the grooves as described. However, rods as big as 0.25 inches or as small as 0.125 inches could be accommodated with no substantial difference in the playing of the instrument.

Thus, the invention provides a superior instrument and method, both in the manufacture and playing of stringed instruments. The fret rods of the invention are virtually non-wearing, and have been noted by musicians to have a better appearance than traditional T-shaped fret rods and to feel much smoother to the fingers during playing. With respect to manufacture of the instrument, all required forming operations to produce the guitar neck are accomplished in one step, including molding of the neck complete with all apertures and grooves for peg heads, frets and other components such as audio-pickups and the like. With appropriate protrusions in the mold, the fret grooves are formed along with the neck and no sawing or separate grooving is required. Moreover, the essentially arcuate form of the mold protrusions for the fret grooves, as opposed to the angular protrusions required for forming slots to receive traditional frets, allows formation of fret-receiving impressions in the absence of turbulence from the flow of material. This turbulence, with angular protrusions, not only disrupts the texture of the playing surface, but has been found to severely erode the protruding surfaces of the mold, which must be replaced at substantial expense. In addition, the installation of the frets is much easier, as no hammering, cutting or sanding is required.

From the foregoing description, one skilled in the art can readily ascertain the essential characteristics of the invention and, without departing from the spirit and scope thereof, can adapt the invention to various usages and conditions. Changes in form and the substitution of equivalents are contemplated as circumstances may suggest or render expedient; and although specific terms have been employed herein, they are intended in a descriptive sense and not for purposes of limitation, the purview of the invention being delineated in the following claims.

Having described my invention according to the requirements of the patent laws, I claim:

1. A fingerboard for a fretted stringed instrument, comprising:

an elongate, unitary body member with a playing surface having a series of grooves which are disposed transversely with respect to a longitudinal dimension of the body member;

the grooves each being essentially U-shaped in cross-section and including a circularly arcuate portion having the arcuate center below the playing surface, with the distance between the transverse edges of each groove at the playing surface being no less than twice the radius of the arcuate portion, and a cylindrical fret member adhesively secured in each of the grooves, each of the fret members being circular in cross-section and matingly engaging the circularly arcuate groove portion with the cylindrical axis of the fret member lying below the playing surface.

2. The fingerboard of claim 1 wherein the adhesive which secures the fret member to the body member extends the circular configuration of the circularly arcuate groove portion around the fret rod to the level of the playing surface.

3. The fingerboard of claim 1 or 2 wherein each of the transverse grooves further includes at least one bridge member disposed across the groove and below the playing surface, and each of the fret members includes at least one slot formed across the fret member which matingly receives a bridge member of the groove.

4. A fingerboard for a fretted stringed instrument, comprising:

an elongate body member molded from resinous material, with a playing surface having a series of grooves which are disposed transversely with respect to a longitudinal dimension of the body member;

the grooves each being essentially U-shaped in cross-section and including a circularly arcuate portion having the arcuate center below the playing surface, with the distance between the U-shaped edges of each groove at the playing surface being no less than twice the radius of the arcuate portion, and a cylindrical fret member adhesively secured in each of the grooves, each of the fret members being circular in cross-section and matingly engaging the circularly arcuate groove portion with the cylindrical axis of the fret member lying below the fret surface and with the adhesive extending the circular configuration of the circularly arcuate groove portion around the fret rod to the level of the playing surface.

5. The fingerboard of claim 4 wherein each of the transverse grooves further includes at least one bridge member disposed across the groove and below the playing surface, and each of the fret members includes at least one slot formed across the fret member which matingly receives a bridge member of the groove.

6. A method for forming a fingerboard for a fretted stringed instrument, comprising:

molding an elongate body member from resinous material, with a playing surface having a series of grooves which are disposed transversely with respect to a longitudinal dimension of the body member, the grooves each being essentially U-shaped in cross section and including a circularly arcuate portion having the arcuate center below the playing surface with the distance between the U-shaped edges of each groove at the playing surface being no less than twice the radius of the arcuate portion;

placing a flowable adhesive agent in each of the grooves;

placing a cylindrical fret member in each of the grooves, the fret members being circular in cross-section and being placed to matingly engage the circularly arcuate groove portion with the cylindrical axis of the fret member lying below the playing surface; and pressing the cylindrical fret member toward the body member to cause the adhesive to flow around the fret rod to the level of the playing surface prior to cure.

7. The method of claim 6 wherein each of the transverse grooves further includes at least one bridge member disposed across the groove and below the playing surface, and each of the fret members includes at least one slot formed across the fret member which matingly receives a bridge member of the groove.

* * * * *